United States Patent [19]

Bittner et al.

[11] 3,981,383

[45] Sept. 21, 1976

[54] RIGHT HAND MARGIN CONTROL SYSTEM

[75] Inventors: John R. Bittner, Waynesboro; Ronald D. Wesner, Crozet, both of Va.

[73] Assignee: General Electric Company, Waynesboro, Va.

[22] Filed: Aug. 1, 1974

[21] Appl. No.: 493,973

[52] U.S. Cl. ..... 197/63

[51] Int. Cl.[2] ..... B41J 21/02

[58] Field of Search ..... 197/63, 107–112, 197/187, 192

[56] References Cited

UNITED STATES PATENTS

| | | | |
|---|---|---|---|
| 3,534,847 | 10/1970 | Willcox | 197/63 X |
| 3,572,487 | 3/1971 | Rolph et al. | 197/63 |
| 3,664,479 | 5/1972 | Arjani et al. | 197/63 |
| 3,757,921 | 9/1973 | Bishop | 197/63 X |

*Primary Examiner*—Paul E. Shapiro

*Attorney, Agent, or Firm*—Michael Masnik

[57] ABSTRACT

A settable margin control switch is actuated when a movable carriage printer approaches the right hand margin. In the keyboard operating mode, an audible alarm is sounded and a predetermined number of character positions later, the printing of keyboard originated data is blocked. In the automatic printing mode, no alarm is sounded, however, printing is terminated and a special character is printed beyond the right hand margin to indicate that the input data has overflowed the printed record.

9 Claims, 4 Drawing Figures

RIGHT HAND MARGIN CONTROL SYSTEM

This invention relates to margin control apparatus for use with recorders, such as printers, which are operable automatically from characters stored on tape or available from a data line, or from characters produced in response to manual keyboard operation. In particular, the invention is directed to arrangements for indicating that a margin limit has been exceeded or is being approached and providing for blocking carriage advance and data printing.

All printing equipment with movable print carriages employs left hand margin control devices in order to produce printed copies that conform to a desired format. Since most writing is done from left to right, the left hand margin is easily and rigidly established. In contrast, the right hand margin can be determined only within a general range that is limited by the operator's ability to complete words that are already started, or hyphenate such words for completion on the next line. Typewriters and similar character printing equipment, provide adjustable means for warning the operator when each line of print approaches a predetermined point. On manual equipment, a bell may be struck when a settable striker is actuated as the carriage reaches the desired position. On electronic equipment, a switch may be actuated to initiate the warning operation. After such warnings it is customary to permit the printing of a limited number of characters only, before the print head is disabled and/or further carriage movement stopped.

Prior right hand margin control systems are generally satisfactory if an operator is present to initiate the required carriage return or work hyphenation, followed by carriage return. However, with equipment that is automatically responsive to a tape reader or on-line data, the printing format may not conform to the data input. A typical problem arises when the data input presumes a longer line than the printer is generating. In this case, a warning alarm is of no value since no operator is available to respond. On the other hand, the printer must be stopped to avoid running off the record medium. Having stopped the printer, one must also disable the print head to prevent printovers in the last character position.

The need for a right hand margin control on equipment responsive to electronic data signals, has spawned a number of systems, including one wherein a variable length right hand margin is provided. In this prior art system, a margin switch is mounted upon the carriage and upon actuation enables counting circuitry to count succeeding characters. The counter is presettable to provide an end of margin signal upon receipt of one or more characters following switch actuation.

There is a need for improved printing apparatus that is responsive to data from a keyboard, a tape reader or a data line. In the event of keyboard input, an audible end of line signal should be provided. In the event of automatic operation from a tape reader or data line, settable means should be provided for terminating line printing at a desired right hand position. Furthermore, a printed indication should be provided whenever a line is terminated by the apparatus so that a subsequent reader of the printed data will be immediately made aware of the fact that the printed record excludes a portion of the data input.

It is an object of the invention to provide an improved right hand control margin arrangement for use with movable carriage printers.

It is another object of the invention to provide an improved movable carriage printer having a settable right hand margin control operative to provide an audible indication in the event of keyboard input and operative to print a discrete symbol in the event that automatic data input exceeds the length of the printed line.

In accordance with a particular embodiment of the invention, there is disclosed a right hand margin control system for printers having a transversely movable printing carriage adapted to print characters in predetermined transverse positions. Settable switch means are mounted for actuation when the carriage reaches the set transverse position thereof, and means are operative when the carriage has thereafter traversed a predetermined number of positions, to effect the printing of a specific character only in the succeeding transverse position.

A complete understanding and appreciation of the invention, will be available from the following detailed description. This description is made in conjunction with the drawings, wherein.

The invention has been embodied in a dot matrix printer of the type disclosed in U.S. patent application Ser. No. 427,657, filed Dec. 26, 1973 and owned by the assignee of this invention. Such printers use an array of wires on a printing assembly that is passed across a record medium. The printing head assembly 10 is selectively controlled by input data signals to activate the appropriate wires and construct desired characters in accordance with a prescribed pattern. A typical dot pattern uses a $5 \times 7$ matrix, in which case, the printing head assembly 10 might be provided with seven vertically arranged wires. As the printing head assembly 10 is moved through five adjacent positions, strobe signals identify each position and selected wires are extended to create the dot pattern that is prescribed by the input data.

The strobe signals that determine the position of the printing head when each dot column is to be printed, may be generated in various ways well known in the art.

It is believed that all essential details for a complete understanding of this invention are described herein, however, a more thorough description of the printer and strobe generator is available in the cited applications.

Figure 1:
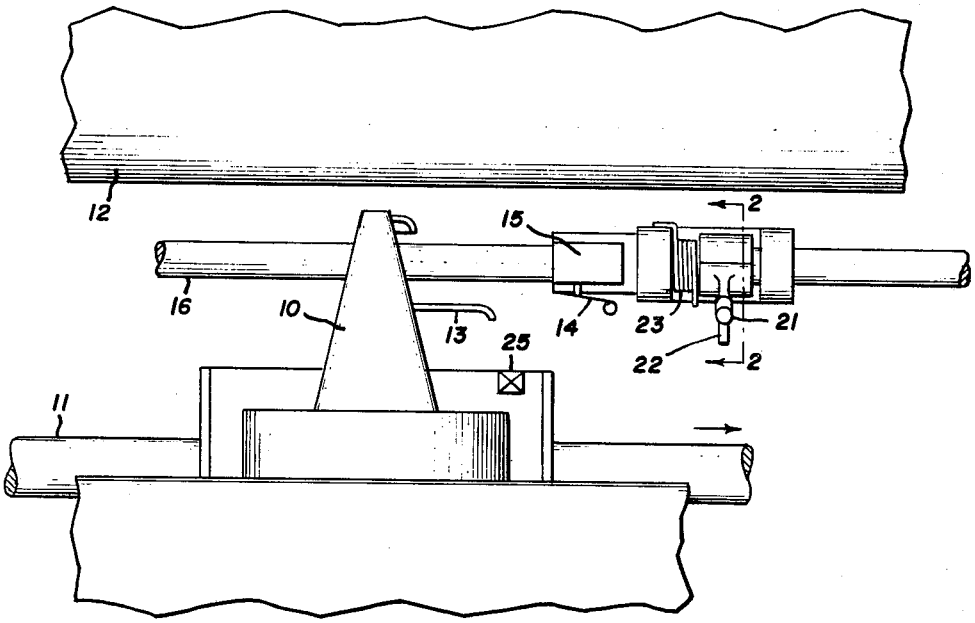
FIG. 1 is a top view showing principal components of a typical movable carriage with switch actuating means for establishment of the right hand margin position.

The pertinent components of the printing assembly of a dot matrix printer appear in FIG. 1. The printing head assembly 10 is mounted for transverse movement along guide rail 11. The printing assembly is actuated in accordance with input data signals to print characters upon record medium 12. The right hand margin control mechanism is mounted upon a shaft 16, which is positioned parallel to the guide rail 11. This mechanism cooperates with the movable printing head assembly 10 when the assembly reaches a predetermined right hand position. At this position, the cam actuating lever 13 on the printing head assembly 10 engages switch follower arm 14 and is effective to activate the right hand margin control switch 15. The margin control mechanism is designed for selective positioning along shaft 16. Thus, one is able to establish the point at which the margin control switch 15 is activated.

Figure 2:
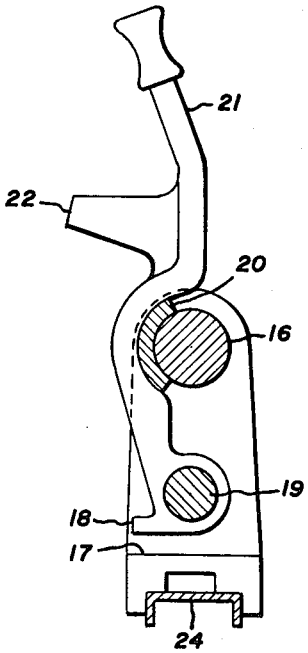
FIG. 2 is a side cross-sectional view taken along lines 2—2 of FIG. 1 and illustrating the control mechanism for setting the right hand margin control switch.

The transverse setting of the right hand margin control mechanism can be understood from a joint consideration of FIGS. 1 and 2. In order to establish a particular right hand margin position, the keyboard operator spaces the printing head assembly 10 to the right in the direction shown by the arrow in FIG. 1, until the desired transverse position is reached. The adjust lever 21 of the right hand margin control mechanism is then pulled toward the keyboard 101 (in a counterclockwise direction in FIG. 2). This releases the friction brake 20 which is normally held against shaft 16 by torsion spring 23. The forward motion of adjust lever 21 is limited by the stop lug 18 hitting against adjust block 17. While the friction brake 20 is disengaged, the operator slides the printing head assembly 10 to the left until the projection 22 on the adjust lever 21 in butting contact with the margin stop lug 25 on the printing head asembly 10. In this position, the adjust lever 21 is released, spring 23 returns the friction brake 20 to engagement with guide shaft 16, and the right hand margin control mechanism is secured in position. During all subsequent operations, when the printing head assembly 10 approaches within the prescribed distance from the right hand margin, cam actuating lever 13 will operate switch 15 and thereby initiate the further operations now to be described.

Figure 3:
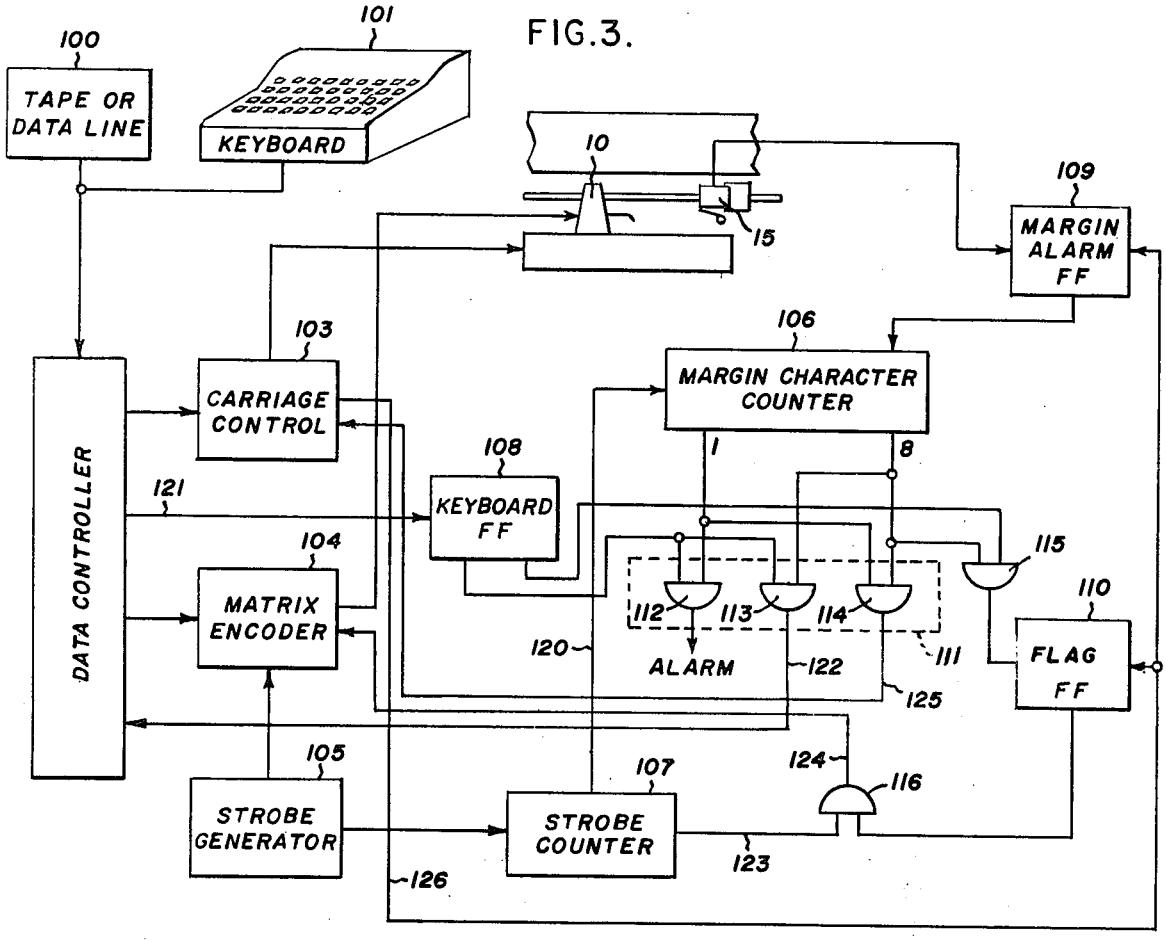
FIG. 3 is a block schematic diagram showing the principal logic components used in a particular embodiment of the invention.

In the block diagram of FIG. 3, the printing head assembly 10 has been schematically separated from the keyboard apparatus in order to visually assist in describing the functioning of the system. Signals representing the characters to be printed or the carriage control functions to be performed, are generated either by tape or data line 100, or by keyboard 101. Data available from source 100 appears in an 8 level ASCII code format and is communicated to controller 102 by means of 8 parallel input lines, one for each of the 8 bits plus a strobe pulse line. The pulse signals the controller when to accept the data. A similar arrangement is provided for keyboard 101. In this latter case, the keyboard strobe signal is applied to the flip-flop 108 to identify when the data source is the keyboard. These signals are applied to a data controller 102 which distributes them to appropriate printer control circuitry. Data controller 102 also receives from the printer and returns to the various data sources, monitoring and control signals. Generally, the carriage control singals are operative via carriage control circuitry 103 to establish carriage operations. Character coding for print wire selection is carried out in matrix encoder 104, which in turn activates the appropriate wires at times established by strobe generator 105.

The components just described, are not unique to this invention and are familiar to those skilled in this art. The aforecited applications contain descriptions of specific embodiments.

The functions of the present invention are achieved by the cooperative utilization of margin character counter 106, strobe counter 107, keyboard flip-flop 108, margin alarm flip-flop 109, parity error flip-flop 110, margin switch 15, and the various illustrated logic gates. The counters may be of conventional type, operative when enabled, to register increasing values as input signals are applied. Selected outputs from each counter are extracted and used in the manner described hereinafter. The flip-flops are also of any conventional type, operative to assume either a "set" or "reset" state upon occurrence of appropriate input stimulii. No attempt has been made to show triggering or synchronizing signals, inasmuch as these details are obvious to those skilled in the art.

Figure 4:
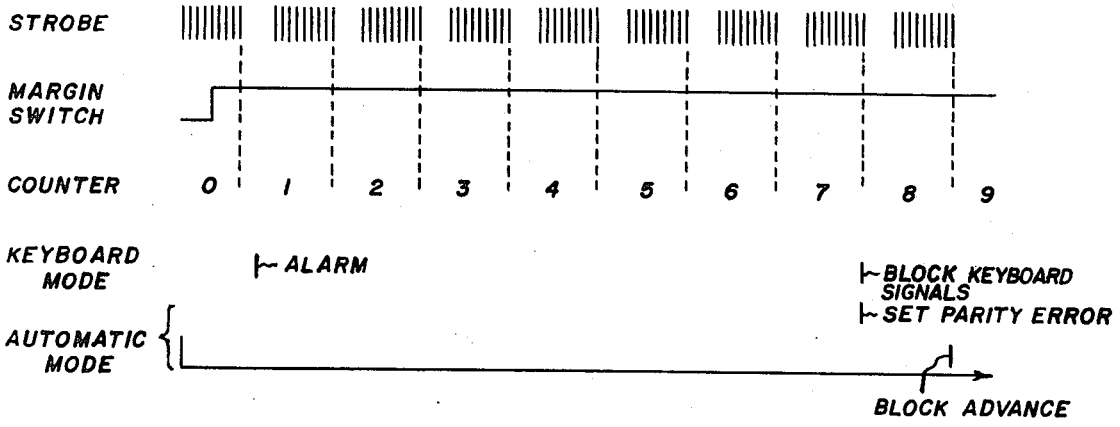
FIG. 4 is a chart useful in graphically illustrating the operation of components of the invention, as a function of time.

Before describing the operation of the invention, a detail of dot matrix printing should be mentioned again. The seven vertically arranged wires on the printing head 10 are enabled at each possible printing position by a strobe pulse from strobe generator 105. In the illustrated embodiment, nine strobe pulses are generated for each character, separated by a period to permit intercharacter spacing. FIG. 4 depicts the time of occurrence of the strobes for nine characters commencing with the character printed when the margin switch 15 is being actuated, and concluding with the last character permitted by the right hand margin control circuitry.

The first operating mode is when the data source is the keyboard. The second operrating mode is when the data source is either a tape reader or data line.

In the keyboard operating mode an audible alarm is activated when the right hand margin switch 15 is tripped. The carriage is then permitted to proceed for seven character positions; after which (the keyboard data is blocked) no further printing can take place with respect to keyboard produced signals.

Under keyboard control, printing proceeds and carriage 10 moves to the right until actuation of the right hand margin switch 15. When switch 15 is actuated, the margin alarm flip-flop 109 is set. The setting of margin alarm flip-flop 109 results in the application of a reset pulse to margin character counter 106 and thereafter this counter is effective to count succeeding character positions, responsive to count input signals from strobe counter 107.

Strobe counter 107 registers a count each time a strobe pulse occurs. It is reset during the intercharacter period. When the strobe counter registers nine, an end-of-character signal is produced on lead 120 and it is this signal that is used as the count input for margin character counter 106. Accordingly, margin character counter 106 registers successive counts after each character is printed, or stated another way, after the printing head assembly has traversed a character position and entered the intercharacter space.

The condition of the margin character counter 106 is used to initiate the desired equipment control functions via decoding circuitry 111. Typical logic AND gates have been shown for this decoding function, assuming that a binary counter is used and that discrete signals appear on the output leads 1, 8 when counts of decimal value 1 and 8 respectively, are registered.

Only when the keyboard is in operation, does data controller 102 produces a signal on lead 121 to set keyboard flip-flop 108. In one embodiment a bid strobe signal accompanying the keyboard generated data is sensed by data controller 102. Accordingly, when margin character counter 106 counts to one, AND gate 112 is enabled by inputs from both the flip-flop and the counter and produces a discrete signal for energizing an audible alarm. This is shown as an alarm signal during the keyboard mode of operation in FIG. 4. The alarm itself is not illustrated.

As the carriage continues to move to the right, each succeeding character position is counted until the end-of-character signal effects a count of eight. At this time, AND gate 113 is enabled by inputs from keyboard flip-flop 108 and margin character counter 106, to produce signals on lead 122 for blocking the recording of discrete character signals produced by the keyboard.

A graphical presentation of the operations described appears in FIG. 4. From this Figure it will be seen that in the keyboard mode of operation, identified by the output of 108 the alarm is activated when the margin switch is tripped, and when the margin counter registers one. The figure also shows that the recording of keyboard produced signals is blocked following seven character positions thereafter.

In the automatic operating mode, when the data source is either a tape reader or data line, there is no need or desire for audible alarm. However, it is desired to print a special character beyond the established printing limit in order to "flag" the fact that the input data has overflowed the margin.

When data is received either from a tape reader or data line, keyboard flip-flop 108 is not set. Accordingly, in the automatic operating mode, AND gates 112 and 113 will not be enabled. On the other hand, as soon as the right hand margin switch 15 is actuated, margin alarm flip-flop 109 will be placed in a set condition and margin counter 160 will be reset. thus, as the carriage continues to move and print under control of strobe generator 107, the end-of-character signals on lead 120 will be counted as in the previous instance. When a count of eight is registered, the output from counter 106 is applied with the reset output of keyboard flip-flop 108 to AND 115 and sets flag or special character flip-flop 103.

A convenient technique for generating the desired special character to indicate the margin overflow condition, is to energize all seven printing wires at all possible times. This results in the printing of a substantially solid square. Since many printing heads will respond to only five dot columns per character, the special signal in the present case is developed by printing in response to the first, third, fifth, seventh, and ninth strobe pulses. A signal is produced on lead 123 from strobe counter 107 when these strobe pulses occur.

The set output of flag flip-flop 110 and the selected outputs from strobe counter 107 are applied as inputs to logic AND gate 116. The signal on lead 124 from AND gate 116 is applied to matrix encoder 104 which in well recognized fashion effects the printing of the special symbol in the ninth position following activation of the right hand margin switch.

Printing of the special signal results in the addition of a further count to margin character counter 106. This condition is used, e.g. via AND 114, to produce signals on lead 125 for application to 102 to block recording by 104 and 10 and for application 103 to block carriage advance by carriage control circuit 103. Thereafter, all signals received from the tape reader or data line, will be disregarded until a carriage-return signal is generated. The carriage-return signal is then applied on lead 126 to reset the margin alarm and flag flip-flops.

The effect of the above described operation is to provide a distinct special symbol or flag in the right hand margin, beyond the normal margin extreme, whenever a line of automatic input data exceeds the length desired on the record medium. A subsquent reader of this printed data thereby obtains a visual indication that data has been omitted from the printed record. As with conventional equipment, the carriage controls respond to carriage-return signals at all times and there is no disruption in the flow of data. The only outward manifestation of operation of the circuitry of this invention, is the printing of a distinctive symbol under automatic operation, when input data may have overflowed the right hand margin.

A particular embodiment of the invention has been shown and described. Those skilled in the art will recognize modifications and design changes, in order to accommodate this invention to equipment other than that specifically described herein. All such modifications as may come within the skill of those in the art, are intended to be embraced within the scope of the appended claims.

What we claim as new and desire to secure by Letters Patent of the United States is:

1. A margin control system in combination will a recorder having a recording assembly that moves across a record medium and records characters in respective column positions in response to discrete character signals available from a source, comprising: switch means settable for actuation by said recording assembly at any selected column position thereof; and indicator means operative in response to said recording assembly transversing a predetermined number of said column positions following actuation of said switch means to control recording of a special symbol in a succeeding column position.

2. A margin control system in accordance with claim 1, wherein said source comprises a keyboard means for producing other discrete character signals, and alarm means operative only in response to said discrete signals being produced by said keyboard means to provide an audible signal upon movement of said recording assembly following actuation of said switch means.

3. A margin control system in accordance with claim 2, comprising means operative only in response to said discrete signals being produced by said keyboard means to block recording of discrete character signals produced by said keyboard means when said recording assembly has traversed a predetermined number of positions following actuation of said switch means.

4. A margin control system in accordance with claim 1, wherein said indicator means comprises a signal generator operative to produce an output signal upon positioning of said recording assembly at the end of each column position following said selected position, a counter operative to count said output signgals, means for enabling said counter upon activation of said switch means, and means operative upon registration of a count corresponding to said predetermined number for generating a discrete character signal representing said special symbol.

5. A margin control system in accordance with claim 4, including means operative upon registration of one count beyond said predetermined number, to prevent further recording in response to subsequent discrete character signals.

6. A margin control system in accordance with claim 5, further including keyboard means for producing discrete character signals, and alarm means operative only in response to discrete signals produced by said keyboard means, to activate an audible signal upon movement of said recording assembly following actuation of said switch means.

7. A margin control system in accordance with claim 6, comprising means operative only in response to said discrete signals being produced by said keyboard means to block recording of further character signals associated with said keyboard means when said recording assembly has traversed a predetermined number of positions following actuation of said switch means.

8. A margin control system in accordance with claim 1, further comprising keyboard means for manually producing other discrete signals; and means responsive to discrete character signals produced by said source and not produced by said keyboard means for indicating the source of said discrete signals and enabling said indicator means to operate only in response to said last named indication.

9. A margin control system for use with recorders having a recording assembly that moves across a record medium and records characters in respective column positions in response to discrete character signals available from a source, comprising: switch means settable for actuation by said recording assembly at any selected column position thereof; and indicator means operative in response to said recording assembly transversing a predetermined number of said column positions following actuation of said switch means to control recording of a special symbol in a succeeding column position.

* * * * *

UNITED STATES PATENT OFFICE

CERTIFICATE OF CORRECTION

Patent No. 3,981,383 Dated September 21, 1976

Inventor(s) John R. Bittner et al.

It is certified that error appears in the above-identified patent and that said Letters Patent are hereby corrected as shown below:

Col. 3, line 25, after "21" insert -- is --

Col. 3, line 55, cancel "singals" and insert -- signals --

Col. 5, line 13, after "108" insert -- , --

Col. 5, lines 57-60, cancel "to produce signals on lead 125 for application to 102 to block recording by 104 and 10 and for application to 103 to block carriage advance by" and insert -- to generate a block-carriage-advance signal on lead 125 that is applied to the --

Col. 6, line 53, cancel "signgals" and insert -- signals --

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*